US009765967B2

(12) United States Patent
Saunders et al.

(10) Patent No.: US 9,765,967 B2
(45) Date of Patent: Sep. 19, 2017

(54) FLEXIBLE GAS PIPE IGNITOR

(71) Applicant: ALSTOM Technology Ltd, Baden (CH)

(72) Inventors: David C. Saunders, Simsbury, CT (US); James P. Sutton, South Windsor, CT (US); Rebecca Lynn Tobiasz, Suffield, CT (US); Gerard Chase, West Suffield, CT (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 686 days.

(21) Appl. No.: 13/910,514

(22) Filed: Jun. 5, 2013

(65) Prior Publication Data

US 2014/0363775 A1 Dec. 11, 2014

(51) Int. Cl.

| | |
|---|---|
| ***F23C 5/32*** | (2006.01) |
| ***F23Q 3/00*** | (2006.01) |
| ***F23C 3/00*** | (2006.01) |
| ***F23C 7/00*** | (2006.01) |
| ***F23C 99/00*** | (2006.01) |

(Continued)

(52) U.S. Cl.

CPC ..... *F23Q 3/008* (2013.01); *F23C 3/008* (2013.01); *F23C 7/002* (2013.01); *F23C 99/00* (2013.01); *F23Q 9/00* (2013.01); *F23Q 13/02* (2013.01); *F23D 2207/00* (2013.01); *F23D 2900/00014* (2013.01); *Y10T 29/49716* (2015.01)

(58) Field of Classification Search

CPC ..... F23Q 3/008; F23Q 9/00; G01V 1/201; G01V 2210/32; G01V 3/083; G01V 3/17; G01V 1/36; G01V 1/362; G01V 1/364; G01V 1/38; G01V 1/3808; G01V 2001/204; G01V 2001/205; G01V 2003/085; G01V 2210/1423; G01V 2210/144

USPC ..... 431/173

See application file for complete search history.

(56) References Cited

U.S. PATENT DOCUMENTS

| | | | | |
|---|---|---|---|---|
| 1,506,145 | A | 8/1924 | Willis et al. | |
| 4,434,747 | A * | 3/1984 | Chadshay | F23D 23/00 110/261 |

(Continued)

FOREIGN PATENT DOCUMENTS

| | | | |
|---|---|---|---|
| CA | 2399021 | A1 | 8/2001 |
| JP | 2006 188725 | A | 5/2006 |

*Primary Examiner* — Jason Lau

(74) *Attorney, Agent, or Firm* — GE Global Patent Operation; Stephen G. Midgley

(57) ABSTRACT

A gas pipe ignitor for igniting a non-premixed air and fuel mixture includes a housing having an axially interior space along its length, a supply end segment, a flame end segment axially spaced from the supply end segment, and a flexible segment spaced between the supply end segment and the flame end segment. A fuel supply conduit extends axially within the housing, and the fuel supply conduit is operatively flexible with the flexible segment. An ignition conduit extends axially within the housing, and the ignition conduit is operatively flexible with the flexible segment. A detector conduit extends axially within the housing, and the detector conduit is operatively flexible with the flexible segment. An air supply conduit is operatively connected to the housing at the supply end segment and provides combustion air within the interior space.

14 Claims, 2 Drawing Sheets

(51) Int. Cl.
*F23Q 13/02* (2006.01)
*F23Q 9/00* (2006.01)

(56) References Cited

U.S. PATENT DOCUMENTS

| | | | | |
|---|---|---|---|---|
| 4,624,240 | A * | 11/1986 | Hitch | F23D 14/64 126/41 R |
| 5,146,858 | A | 9/1992 | Tokuda et al. | |
| 6,202,575 | B1 | 3/2001 | Bauver, II et al. | |
| 6,311,475 | B1 | 11/2001 | Ngo-Beelman et al. | |
| 6,443,728 | B1 | 9/2002 | Edberg et al. | |
| 7,114,526 | B2 * | 10/2006 | Takagi | F16L 11/085 138/121 |
| 7,492,269 | B2 | 2/2009 | Matteson et al. | |
| 2008/0171295 | A1 * | 7/2008 | Yang | F23Q 3/002 431/255 |
| 2011/0033807 | A1 * | 2/2011 | Wang | F23C 5/08 431/10 |
| 2012/0028199 | A1 * | 2/2012 | Boguszewski | F23D 14/725 431/13 |

* cited by examiner

FLEXIBLE GAS PIPE IGNITOR

FIELD OF THE INVENTION

The present disclosure relates, in general, to an ignitor for a fossil fuel fired combustion chamber, and more particularly to a gas pipe ignitor having improved flexibility and performance.

BACKGROUND OF THE INVENTION

In order to begin a combustion process inside a fossil fuel fired combustion chamber, such as that found in industrial and utility boilers, an energy source, such as a gas pipe ignitor is required to begin a self-sustaining combustion reaction of main fuel and air.

Ignitors generally have a dedicated fuel and air supply, a flame ignition source, and a flame detector. In operation, fuel and air are introduced to the ignitor and the ignition source provides a spark to begin a self-sustaining reaction that keeps the ignitor burning. The flame detector provides proof that the ignitor is operating.

In a combustion chamber, such as a tangential or a wall fired boiler, ignitors can be mounted to structural elements. For example, in a tangential boiler, pulverized coal and air are introduced into a furnace through fuel-air admission assemblies disposed in structural elements called windboxes located in the corners of the furnace. Auxiliary fuel burners, which includes an ignitor disposed within a moveable air nozzle, are also located in the windboxes, proximate to the fuel-air assemblies. The auxiliary fuel burners and fuel-air assemblies are aimed tangentially to an imaginary circle in the middle of the furnace to create a fireball, which serves as source of ignition for the incoming coal. A distinct advantage of the tangential firing boiler is that steam temperature can be controlled by tilting in unison the fuel-air admission assemblies and auxiliary fuel burners of the individual windbox upward or downward. By doing so, the fireball is physically raised or lowered within the furnace, which increases or decreases the heat absorption by the water walls in the furnace. An example of a tangential boiler is disclosed in U.S. Pat. No. 4,434,747.

Ignitors use a wide variety of gas and oil fuels, and selection of fuels usually depends on availability and costs. Due to cost considerations, combustion facilities with oil ignitors disposed in moveable structural elements have attempted to convert to gas pipe ignitors with limited success. Current gas pipe ignitors are rigid, which when coupled to a movable nozzle tip, limits the directional movement and control of the nozzle tip. While attempts have been made to modify moveable nozzle tips to accommodate a rigid gas pipe ignitor, such modifications have drawbacks. For example, one such modification includes insertion of slots into directional blades of the nozzle tip in order to allow the nozzle tip to tilt upward and downward while rigid gas pipe ignitor remains stationary. A disadvantage of such a modification of the nozzle tip includes reduced effectiveness of nozzle tips.

SUMMARY OF THE INVENTION

It is an object of the present invention to provide a gas pipe ignitor for igniting a non-premixed air and fuel mixture. The ignitor contains a housing having an axially interior space along its length, a supply end segment, a flame end segment axially spaced from the supply end segment, and a flexible segment spaced between the supply end segment and the flame end segment. The ignitor further contains a fuel supply conduit extending axially within the housing, the fuel supply conduit operatively flexible with the flexible segment. The ignitor further contains an ignition conduit extending axially within the housing, the ignition conduit operatively flexible with the flexible segment. The ignitor further contains a detector conduit extending axially within the housing, the detector conduit operatively flexible with the flexible segment; and an air supply conduit operatively connected to the housing at the supply end segment to provide combustion air within the interior space.

It is another object of the present invention to provide a gas pipe ignitor wherein the housing is gas-tight from the supply end segment to the flame end segment.

Still another aspect of the invention is to provide a deflector body disposed within the interior space of the housing between the flexible segment and the flame end segment, the deflector body configured to mount the fuel supply conduit, the ignition conduit, and detector conduit within the axially interior space.

Yet another object of the present invention is to provide a braided sheath disposed over the flexible segment, the braided sheath operatively flexible with the flexible segment.

Another object of the present invention is to provide an optical detector disposed within the detector conduit.

The various novel features that characterize the subject systems and methods, and advantages related thereto are specified in the accompanying drawings and detailed description provided below.

DETAILED DESCRIPTION OF THE INVENTION

Figure 1:
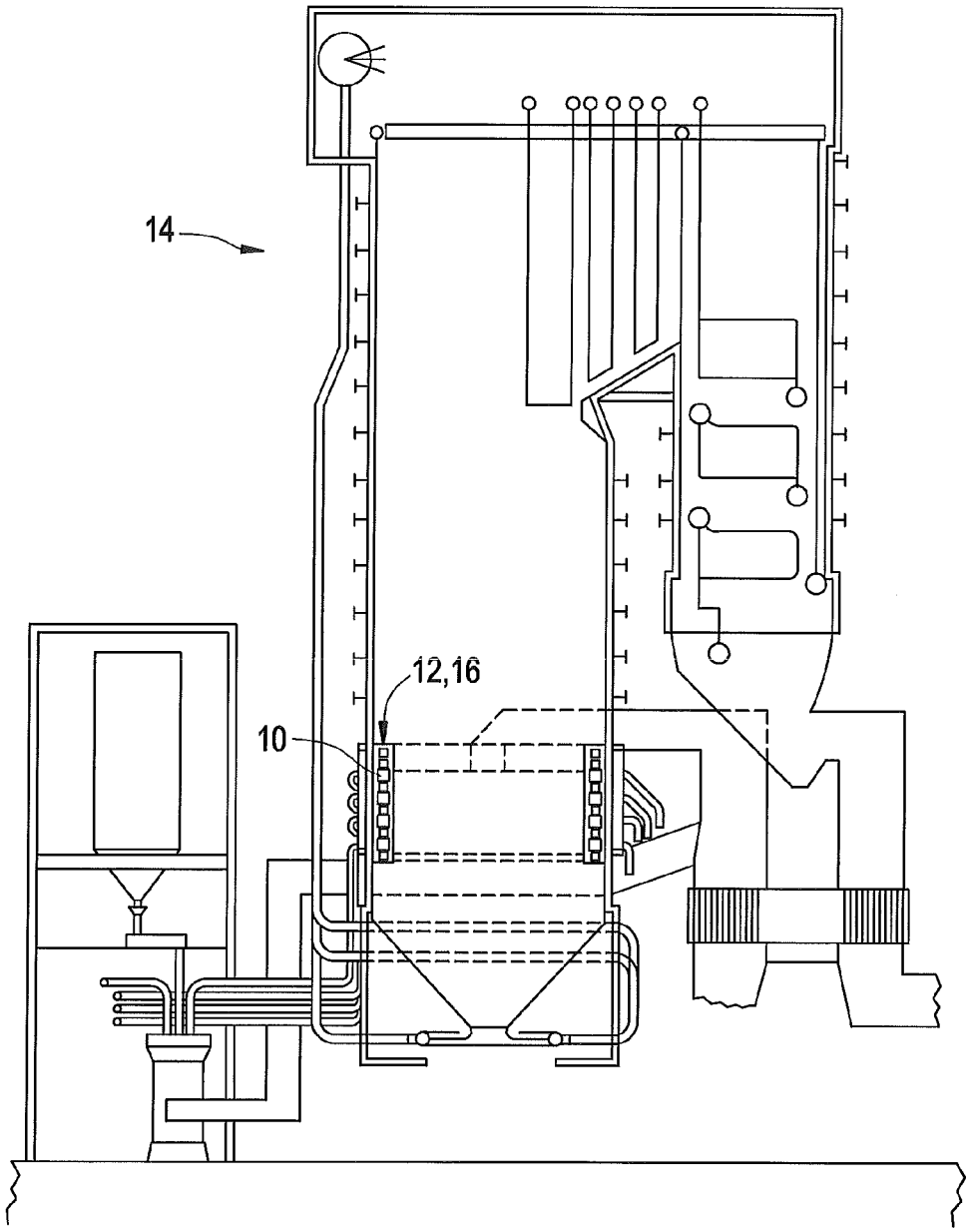
FIG. 1 Prior Art
FIG. 1 is a schematic view of a pulverized coal firing combustion assembly having a windbox assembly mounted thereon.

As shown in FIGS. 1-4, one embodiment of the gas pipe ignitor, generally designated as the flexible gas pipe ignitor 10, is adapted to be mounted on a moveable structural element of a fossil fuel firing combustion assembly, such as, for example, on a structural element 12 of a pulverized coal firing furnace 14, which may be, for example, a structural element in the form of a windbox 16 in a tangential firing chamber or a wall-fired burner.

The flexible gas pipe ignitor 10 is operable to ignite a non-premixed air and gaseous fuel mixture, such as natural gas, propane, or another gas fuel. A flexible gas pipe ignitor is also operable to provide auxiliary heating service to the fossil fuel firing combustion assembly. The flexible gas pipe ignitor 10 can be operated, for example, to warm up the combustion chamber of the pulverized coal firing furnace 14 during a start-up operation thereof at a stage of the start-up operation prior to the combustion of pulverized coal introduced into the combustion chamber. Alternatively or in addition, the flexible gas pipe ignitor 10 can be operated to light the main fuel such as, for example, the pulverized coal in a pulverized coal firing combustion assembly.

The flexible gas pipe ignitor 10 includes an air supply conduit 30 operably connected to a housing 34. The housing 34 has a supply end segment 38, a flame end segment 42 axially spaced along axis X from the supply end segment 38, a flexible segment 46 disposed between the supply end segment and flame end segment, and an interior space 50 within the housing. Combustion air is fed into the interior space 50 of the housing via the air supply conduit 30.

Figure 2:
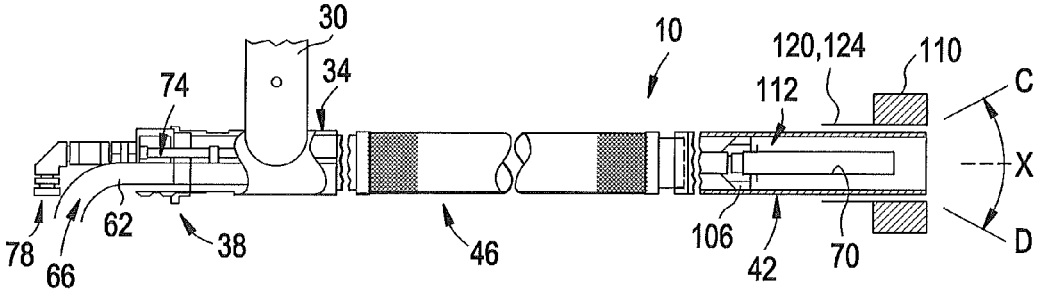
FIG. 2 is a schematic side view of a first embodiment of a gas pipe ignitor and moveable nozzle tip.
Figure 3:
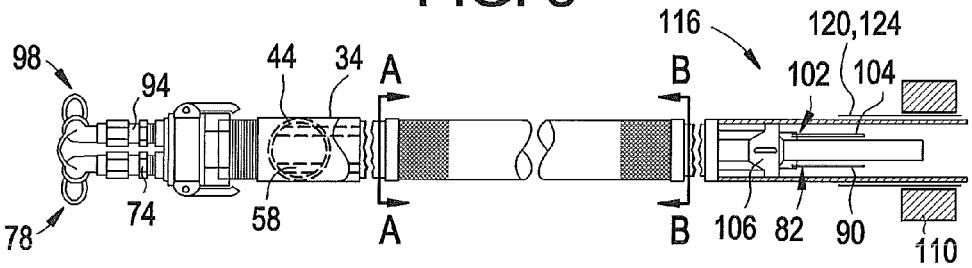
FIG. 3 is a schematic top view of the first embodiment.
Figure 4:
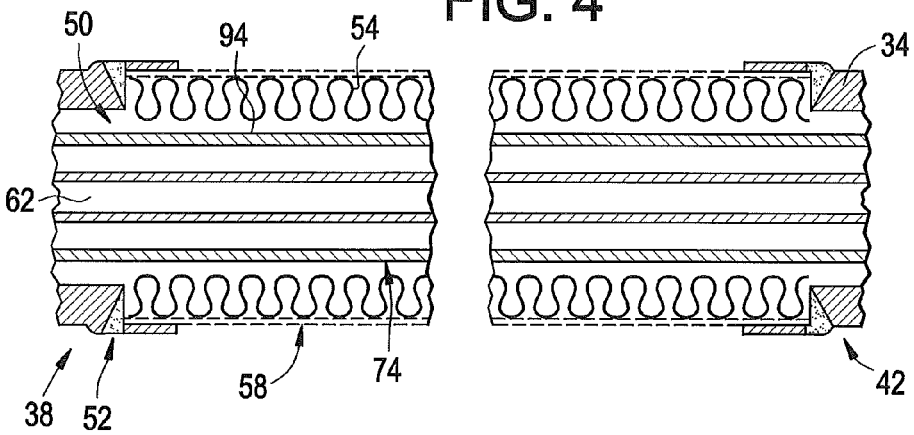
FIG. 4 is an enlarged cross sectional view of the first embodiment taken along lines A-A and B-B of FIG. 3.

In the embodiment shown in FIGS. 2-4, the supply end segment and flame end segment are rigid. In alternative embodiment (not shown), the housing proximate to supply end and flame end are flexible.

The flexible segment 46 is coupled to the supply end segment 38 and flame end segment 42 by means of a weld 52 or other suitable gas tight coupling mechanism. The flexible segment can in the form of gas-tight corrugated metal tubing 54.

Covering the flexible segment 46 is a protective sleeve 58. The protective sleeve can provide additional thermal and/or mechanical protection to the flexible segment. The protective sleeve can be in form of a flexible steel braided sleeve.

The flexible gas pipe ignitor also includes a fuel supply conduit 62 extending axially interiorly within at least a portion of the housing 34 and has an entrance end 66 and exit end 70. The fuel supply conduit is operatively flexible with the flexible segment 46. The fuel supply conduit can be entirely flexible, or at least portion of the fuel supply conduit is flexible. The fuel supply conduit provides a pilot fuel in the form of a gas that is mixed with air in a controlled zone downstream of the flexible segment, in which combustion is initiated and sustained.

The gas pipe ignitor further includes an ignition conduit 74 that is coupled to the housing 34. At least a portion of the ignition conduit is disposed interiorly within the housing 34. The ignition conduit is operatively flexible with the flexible segment 46. The ignition conduit has a conduit entrance 78 and a conduit exit 82. At the conduit exit, a spark rod 90 extends within the interior space 50 of the housing. The spark rod 90 provides an ignition source to ignite the pilot fuel.

The ignitor further includes a detector conduit 94 that is coupled to the housing and at least a portion is disposed interiorly within the housing 34. The detector conduit has an entrance end 98 and an exit end 102. The detector conduit is operatively flexible with the housing 34. At the exit end 102, a flame rod detector 104 passes through the detector conduit 94 and extends within the interior space 50 of the housing. The flame rod detector 104 can be retractable within the detector conduit. The flame rod detector can be an optical sensor to detect the presence of a flame, and/or a voltage sensor to detect fluctuations in flame ions. The detector conduit can comprise of a flexible fiber optic flame scanner.

The gas pipe ignitor also includes a deflector body 106 disposed interiorly within at least a portion of the housing towards the flame end 42. The deflector body 106 mounts the fuel supply conduit 62, ignition conduit 74, and detector conduit 94 through one or more apertures on the downstream side of the flexible segment 46. The deflector body can be in the form of a bluff body, such as described in U.S. Pat. No. 6,443,728.

In a structural element 12, such as a windbox for a tangential boiler, the flexible gas pipe ignitor 10 can have a diameter of three to five inches, and provide a release rate between 0.5 to 30 MMBTU per hour. The components within the air conduit are generally designed to withstand combustion air entering the air supply conduit of temperatures between 200-800 degrees F., even more specifically 400-600 degrees F.

The flame end of the flexible gas ignitor pipe is operatively associated with a moveable air nozzle 110 to form an auxiliary fuel burner assembly 116. The moveable air nozzle comprises a coupling means 120 to connect the flexible gas ignitor with the moveable air nozzle 110. In an embodiment, the coupling means is a guide pipe 124 operatively connected to the moveable air nozzle, such as through a welded connection. The guide pipe 124 is configured to allow the flexible gas ignitor 10 to be inserted therewith.

The auxiliary fuel burner assembly 116 can be adjusted about axis X in order to direct the source of ignition for combustion in the furnace. The moveable air nozzle can tilt from −30 to 45 degrees in an upward or downward angle CD about axis X, more preferably −15 to 40 degrees, even more preferably 0 to 30 degrees. By providing a gas tight housing with a flexible segment, and flexible conduits therein, the gas ignitor is able to flexible adjust in response to the moveable air nozzle 110.

The auxiliary fuel burner assembly can be operatively disposed within a windbox of a tangential firing combustion chamber. Alternatively, the flexible gas pipe ignitor can be operatively disposed within a structural element of a wall-fired burner.

A convention oil pipe ignitor can be retrofitted with a gas pipe ignitor by removing the oil pipe ignitor and air nozzle, and replacing the oil pipe ignitor with a gas pipe ignitor and air nozzle as described herein. The fuel supply lines, as well as flow regulators, valves are also retrofitted for the use of gas. Through this retrofit, the operational integrity and movement of the structural element, such as the windbox, is maintained.

In an embodiment, a pulverized coal-fired steam generator having a combustion chamber and a fuel-air admission assembly and an auxiliary fuel burner assembly disposed in a moveable structural element, the auxiliary fuel burner assembly contains a flexible gas ignitor pipe operatively connected a moveable air nozzle. The flexible gas pipe ignitor comprises a housing having an axially interior space along its length, a supply end segment, a flame end segment axially spaced from the supply end segment, and a flexible segment spaced between the supply end segment and the flame end segment, a fuel supply conduit extending axially within the housing, the fuel supply conduit operatively flexible with the flexible segment; an ignition conduit extending axially within the housing, the ignition conduit operatively flexible with the flexible segment; a detector conduit extending axially within the housing, the detector conduit operatively flexible with the flexible segment; and an air supply conduit operatively connected to the housing at the supply end to provide combustion air within the axially interior space.

In another embodiment, the housing is gas-tight from the supply end segment to the flame end segment. In yet another embodiment, a deflector body is disposed within the axially interior space of the housing between the flexible segment and the flame end, and the deflector body is configured to mount the fuel supply conduit, the ignition conduit, and detector conduit within the axially interior space. In even a further embodiment, a braided sheath is disposed over the flexible segment, and the braided sheath is operatively flexible with the flexible segment. Further still, in yet another embodiment, a flexible optical detector is disposed within the detector conduit. In another embodiment, the structural element is a tangential firing windbox. In yet another embodiment, the structural element is a wall fired windbox. In even a further embodiment, the moveable air nozzle pivots about an axis to tilt the flexible gas pipe ignitor and moveable air nozzle from −30 to 45 degrees. Further still, in yet another embodiment, the moveable air nozzle pivots about an axis to tilt the flexible gas pipe ignitor from −15 to 40 degrees.

In another embodiment, a method for retrofitting an ignitor in auxiliary fuel burner assembly disposed in a moveable structural element comprises removing an oil pipe ignitor from the auxiliary fuel burner assembly, and replacing the oil pipe ignitor with a flexible gas pipe ignitor as described in above.

While the present invention has been described with reference to a number of preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A gas pipe ignitor for igniting a non-premixed air and fuel mixture, comprising:

a housing having an axially interior space along its length, a supply end segment, a flame end segment axially spaced from the supply end segment, and a flexible segment spaced between the supply end segment and the flame end segment, a fuel supply conduit extending axially within the housing, the fuel supply conduit operatively flexible with the flexible segment;

an ignition conduit extending axially within the housing, the ignition conduit operatively flexible with the flexible segment;

a detector conduit extending axially within the housing, the detector conduit operatively flexible with the flexible segment;

a flexible optical detector retractably disposed within the detector conduit; and an air supply conduit operatively connected to the housing at the supply end segment to provide combustion air within the interior space.

2. The gas pipe ignitor according to claim 1 wherein the housing is gas-tight from the supply end segment to the flame end segment.

3. The gas pipe ignitor according to claim 1 further comprising a deflector body disposed within the interior space of the housing between the flexible segment and the flame end segment, the deflector body configured to mount the fuel supply conduit, the ignition conduit, and detector conduit within the axially interior space.

4. The gas pipe ignitor according to claim 1 further comprising a braided sheath disposed over the flexible segment, the braided sheath operatively flexible with the flexible segment.

5. A pulverized coal-fired steam generator having a combustion chamber comprising a fuel-air admission assembly and an auxiliary fuel burner assembly disposed in a moveable structural element, the auxiliary fuel burner assembly comprising:

a flexible gas ignitor pipe operatively connected a moveable air nozzle; the flexible gas pipe ignitor comprising:

a housing having an axially interior space along its length, a supply end segment, a flame end segment axially spaced from the supply end segment, and a flexible segment spaced between the supply end segment and the flame end segment, a fuel supply conduit extending axially within the housing, the fuel supply conduit operatively flexible with the flexible segment;

an ignition conduit extending axially within the housing, the ignition conduit operatively flexible with the flexible segment;

a detector conduit extending axially within the housing, the detector conduit operatively flexible with the flexible segment;

a flexible optical detector retractably disposed within the detector conduit; and an air supply conduit operatively connected to the housing at the supply end to provide combustion air within the axially interior space.

6. The generator according to claim 5 wherein the housing is gas-tight from the supply end segment to the flame end segment.

7. The generator according to claim 5 further comprising a deflector body disposed within the axially interior space of the housing between the flexible segment and the flame end, the deflector body configured to mount the fuel supply conduit, the ignition conduit, and detector conduit within the axially interior space.

8. The generator according to claim 5 further comprising a braided sheath disposed over the flexible segment, the braided sheath operatively flexible with the flexible segment.

9. The generator according to claim 5 wherein the structural element is a tangential firing windbox.

10. The generator according to claim 5 wherein the structural element is a wall firing windbox.

11. The generator according to claim 5 wherein the moveable air nozzle pivots about an axis to tilt the flexible gas pipe ignitor and moveable air nozzle from −30 to 45 degrees.

12. The generator according to claim 5 wherein the moveable air nozzle pivots about an axis to tilt the flexible gas pipe ignitor from −15 to 40 degrees.

13. A method for retrofitting an ignitor in auxiliary fuel burner assembly disposed in a moveable structural element comprising removing an oil pipe ignitor from the auxiliary fuel burner assembly, and replacing the oil pipe ignitor with a flexible gas pipe ignitor as described in claim 1.

14. A gas pipe ignitor for igniting a non-premixed air and fuel mixture, comprising:

a housing having an axially interior space along its length, a supply end segment, a flame end segment axially spaced from the supply end segment, and a flexible segment spaced between the supply end segment and the flame end segment;

a fuel supply conduit extending axially within the housing, the fuel supply conduit operatively flexible with the flexible segment;

an ignition conduit extending axially within the housing, the ignition conduit operatively flexible with the flexible segment;

a detector conduit extending axially within the housing, the detector conduit operatively flexible with the flexible segment;

a flexible optical detector retractably disposed within the detector conduit;

an air supply conduit operatively connected to the housing at the supply end segment to provide combustion air within the interior space; and wherein the gas pipe ignitor has a release rate between 0.5 to 30 MMBTU per hour and is operatively connected to a moveable nozzle that pivots −30 to 45 degrees about an axis.

* * * * *